United States Patent [19]

Sill et al.

[11] Patent Number: 4,726,712

[45] Date of Patent: Feb. 23, 1988

[54] METHOD OF PIPELINE FILLING THE INTERSTICES OF CONTROLLED CAVING AREAS

[75] Inventors: Friedrich Sill; Ulrich Krämer; Hans Maurer, all of Essen, Fed. Rep. of Germany

[73] Assignee: Bergwerksverband GmbH, Essen-Kray, Fed. Rep. of Germany

[21] Appl. No.: 722,240

[22] Filed: Apr. 11, 1985

[30] Foreign Application Priority Data

Apr. 11, 1984 [DE] Fed. Rep. of Germany ..... 3413602
Nov., 1984 [DE] Fed. Rep. of Germany ..... 3440783

[51] Int. Cl.[4] ..... E21F 15/00; E02D 3/12

[52] U.S. Cl. ..... 405/263; 405/267; 299/11

[58] Field of Search ..... 405/132, 258, 263–267, 405/269, 270, 288; 166/292, 293; 299/11, 43

[56] References Cited

U.S. PATENT DOCUMENTS

| | | | |
|---|---|---|---|
| 1,004,419 | 9/1911 | Griffith | 299/11 |
| 3,500,934 | 3/1970 | Magnuson | 405/267 X |
| 3,817,039 | 6/1974 | Stewart et al. | 405/267 X |
| 4,056,939 | 11/1977 | Alvarez-Calderon | 405/267 |
| 4,101,333 | 7/1978 | Wayment | 405/267 X |
| 4,289,354 | 9/1981 | Zakiewicz | 299/11 X |
| 4,340,254 | 7/1982 | Barsi et al. | 405/267 X |
| 4,417,760 | 11/1983 | Vidal | 405/267 |

FOREIGN PATENT DOCUMENTS

| | | | |
|---|---|---|---|
| 2943693 | 5/1981 | Fed. Rep. of Germany | 405/267 |
| 840381 | 6/1981 | U.S.S.R. | 405/267 |

*Primary Examiner*—Nancy J. Stodola
*Attorney, Agent, or Firm*—Karl F. Ross; Herbert Dubno

[57] ABSTRACT

In conjunction with the face mining of bituminous coal, previously excavated or some portions of the tunnel are collapsed in a manner to form a mass of debris into which a mixture of electrostatic filter ash and water is injected to stabilize the structure.

10 Claims, 4 Drawing Figures

METHOD OF PIPELINE FILLING THE INTERSTICES OF CONTROLLED CAVING AREAS

FIELD OF THE INVENTION

Our present invention relates to a method of filling the interstices or hollow spaces of controlled caving areas in underground mines and drifts, especially in the face mining of bituminous coal. The invention also relates to a pipeline for carrying out the improved method.

BACKGROUND OF THE INVENTION

Traditionally during the excavation of coal deposits, e.g. beds of bituminous coal, filling material is injected to reduce the settling of the roof (overlying beds) and rock structure. As such, the extent of damage due to mining and the reduction of the effects of pressure on mining installations is greatly reduced.

In addition the deployment of filling material is of importance to mine ventilation, the climate within the mine and the protection of the environment against the release of gases and the like.

Particularly in the German mining industry, filling operations have been unable to keep up with the exploitation of the mine and with standing support techniques over the last two decades. Similar problems have been encountered in other countries in which mining is significant. As a consequence, there have been considerable detrimental results, including damage to surface formations resulting from the mining, depth-related pressure and mine-climate conditions and the problems stemming from storage of mining debris.

Consequently, the stabilization of controlled collapsed regions in such mines has provided technical and economic advantages which have caused such approaches to become widespread.

However, the introduction or deployment of filling material does not find practical application in modern fully automated space mining operations unless there is a certain thickness of the coal bed, at this time approximately 1.8 meters. Where there is a deeply inclined coal bed, the use of conventional filling materials may not be able to stabilize the structure because the filling material, with the high angle of slope, itself is not easily stabilized.

The introduction of a pneumatic packing requires more costly labor and material support and presupposes a suitable infrastructure to enable the entire operation to be carried out and to provide the storage facilities and the facilities for handling the material which is to be injected.

Economic conditions have encouraged the increased use of controlled caving where the bringing down of the roof is carried out after the removal of the coal deposits. Because of the increase in volume of the loose debris, the resulting hollow spaces must be filled which, in turn, provides fresh support for the new main roof structure thus formed.

This problem cannot be solved by loose debris which is available from the collapse or with conventional packing of this debris and, as a consequence, the downward pressure of the strata lying above the collapsed region may be insufficiently supported.

In addition to the danger of environmental damage, the fact that hollow spaces of varying volume may result from the controlled caving, presents significant problems because gases are not easily eliminated. Ventilation of the mine becomes a problem and mine fires can result from spontaneous combustion.

OBJECTS OF THE INVENTION

It is the principal object of the present invention to improve controlled-collapse coal mining and like subterranean structure and strata stabilization whereby disadvantages of the prior art systems mentioned above are obviated.

It is another object of our invention to provide—in conjunction with controlled mining—a method which affords the possibility of reducing the settling of overlying beds or strata while avoiding the above-mentioned disadvantages.

Still another object of the invention is to provide a simple and cost-effective method of controlled cave-in mining which minimizes detriment to the environment and can also eliminate some of the problems which result from the presence of large or numerous hollow areas in the collapsed structures.

SUMMARY OF THE INVENTION

According to the present invention, these objects are attained by filling the hollow spaces above and within the collapsed debris, preferably in a bituminous coal mining operation, with a mixture of fine-grained filler, especially electrostatic precipitator or filter ash and water, the fine-grained material having a grain size which can range from the micron particle size to a particle size of the order of millimeters although preferably it is in the particle size range which can be collected by an electrostatic precipitator or filter as used in metallurgical gas-cleaning operations or in the cleaning of combustion gases, e.g. from power plant boilers and the like.

The claimed invention differs from the traditional methods of backfilling hollow spaces, which require these spaces to be filled at a later time, by immediately following the controlled collapse with the filling of the spaces within and above the debris. According to the invention, the controlled collapse can be effected at a distance of 5 to 30 meters away from the face being mined.

The filling material can be made up of a mixture of solids and water with a high solids content, preferably in excess of 50% by volume solids.

According to a feature of the invention, to the electrostatic filter ash/water mixture other materials can be added, including floatation mining debris, finely divided and fine-grained rock and even calcium sulfates or gypsum slurries derived from the wet processes for the removal of sulfur from flue gases, thereby affording the necessary quantities of filling material for large-scale operations.

According to the invention, the filling material is forced into the hollow areas where interstices of the collapsed structure by means of the hydrostatic pressure of the shaft structure or column and/or by means of solids-handling or slurry-handling pumps via boreholes, lost pipes, hoses or other slurry discharge means.

The required boreholes can originate at parallel tunnels, drifts or galleries close to the tunnel, drift or structure to be supplied with the slurry, via cross-cut shafts or galleries or by any other convenient means for delivering the slurry from one subterranean or above-ground location to the site to be stabilized.

Boreholes which may be used for this purpose can be provided for degasification subsequently and may be backfilled or may be filled with the slurry which is supplied in accordance with the invention.

In addition, lost pipes can be left in the collapsed zone from the excavating region or drag pipes can be attached to the walking support for the excavating region and can extend into the collapsed zone. The pipes provided may be supplied by appropriate distribution pipes or manifolds.

The invention thus makes use of the collapsed debris as a support skeleton which, because it is filled with the slurry, the solids of which pack in place effectively, can no longer be compressed by the overlying roof strata.

The mixture to be used in conjunction with the present invention is pressed in a thixotropic condition into the hollow spaces of the controlled caving area. The solids content of the filling material-water mixture should range between 50 to 70% by volume. After elimination of excess water, the latter being taken up by the dry debris, the filling material practically solidifies. Burdening the regular mining operation with filtered excess water can thus be avoided to a great extent or completely.

The dense inclusion of large rock structure in the debris in a mass of the finest and fine-grained solids in the sense of the instant invention suffices for stabilizing any sloping structure in spite of steep angles of inclination. In the sense of the present method, stabilization of the hollow areas is accomplished because the filling is sufficient to counteract the roof pressure of the overlying strata and the lateral pressure, i.e. shearing or bending stress, does not arise.

To carry out the method of the invention, we provide a pipeline which will be referred to as an entrainment duct or drag duct and which can be moved away from the collapsed zone with the accompanying support structure providing temporary support in the excavation zone, this pipeline being able to withstand the pressures caused by the controlled caving method and which can, in addition, be attached easily to the face ducts or lines.

According to the invention, this entrainment duct is constituted of thick-walled transport pipes connected flush or uniformly with one another and provided at a free end with at least one discharge pipe. The entrainment duct is attached by means of a flexible connection and coupling part to the face conveyor and/or to parts of the roof support system.

An intermediate pipe may be connected to the transport pipes and can be provided with a supply hose coming from the face conveyor and equipped with an intake fitting.

Through the branches of the service line, distribution of the flow of the filling material to the individual transport pipes is effected. Distribution may be undertaken in accordance with the density of the debris under manual control and/or by means of pressure-sensitive or actuated switchover valves. The entrainment duct has the function of transporting the materials from the face line via the specific branch to the hollow spaces of the controlled caving area.

Across the length of 2 to 3 meters, the entrainment duct is safely received in the propped area of the gallery. Over a length of 10 to 20 meters, however, the entrainment duct is covered with debris behind the supports for the roof structure of the gallery in which mining is effective. The entrainment duct can be disposed on the floor of the coal bed and is, of course. constructed so as to be able to withstand the pressure of the overlying rock masses and the impact of the crumbling roof without significant distortion.

At the same time, the line should be able to withstand the requisite tensile force which drags the line through the rock structure. The spacing between the face line and the drag duct can be between 6 and 12 shield unit widths, the spacing being selected in accordance with the potential spread of the filling material.

The entrainment ducts can be connected to the face conveyor or the shield-type roof support units, e.g. at the sledge runner, in accordance with the required tensile force. The pulling of the pipe through the collapsed structure occurs with the use of the hydraulic traveling mechanism which moves the traveling support and can supply the requisite tensile force. The entrainment duct is moved when the conveyor is shifted, i.e. before the advance of the mechanical supports.

According to yet another feature of the invention, the intermediate pipe is provided with a connecting fitting flushing water and a connecting fitting for high pressure water whereby the fitting for the high pressure water is in communication with a high pressure line within the entrainment duct.

After the filling operation the pipeline is cleaned by the flushing water and the discharge is activated via high pressure water only after prolonged disuse.

The dimensions of the entrainment duct, i.e. its inside and outside diameters, thickness of the pipe wall and cross sections of the discharge openings are naturally selected so as to provide the required rate of flow and the desired pressure levels and to be able to support the loads through which the pipeline may be subject.

According to another feature of the invention, the connecting part forms a single unit with the coupling part and is capable of a pivoting movement, this structure being so connected that it can withstand the tension which may be applied. The structure is connected to each coal facing end of the transport pipes.

This type of pipe connection not only guarantees the proper entrainment of the duct, but it also permits detachment in the case of loss of the entrainment duct.

The advantages of the present invention are that the invention can reduce the settling of overlying strata and thus contributes to a reduction of interior and exterior damage to mining operations. Furthermore, the debris of controlled caving operations is made highly stable and thus has a long-term effect in avoiding environmental damage. Furthermore, with the partial or complete filling of the fallen debris, underlying and overlying tunnels and adjacent mining installations are protected. If needed, only the edge portions or boundary zones of the debris may be filled for the purpose of protecting parallel subterranean structures or the final stages of face mining so that removal of shield-type support units can be facilitated.

Even apart from the reduction in the settling of the overlying beds, the filling-in of the debris area contributes to an improvement of the condition of the roof which is prone to cave-in because of fault zones or where mining installations are permitted to cave in for the purpose of reducing gas or water accumulation, and to regulate air circulation in mine structures or to facilitate the crossing of old mine structures.

Additional filling of the existing caved-in areas, especially in high-sloped areas for the purpose of stabilizing the sloping fill or limiting compression of the filling material, constitutes a significant improvement over the art.

The method of the invention allows the use of drill holes where mining installations were left open in old mining areas to reduce the settling of surface areas and associated damage.

In addition, isolation of mining fires by filling in partial areas or remaining coal areas is possible in accordance with the principles of this invention.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
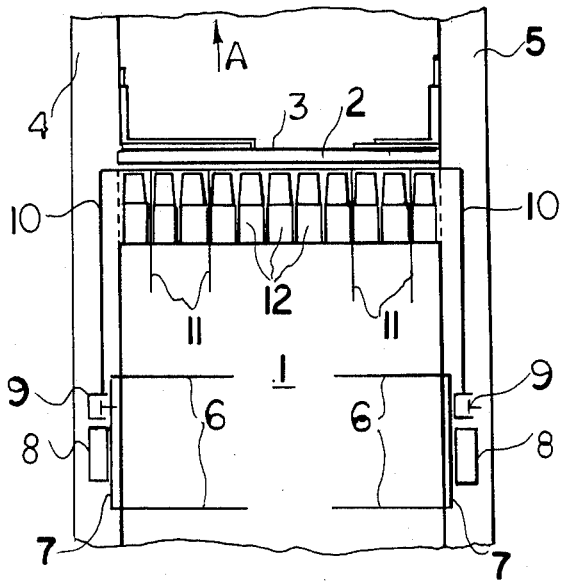
FIG. 1 is a top view in the schematic illustration of executing the backfilling of a controlled caving area in connection with a face operation.

Illustrated in FIG. 1 is the top view, in schematic form, onto an open controlled caving field of a face 2 with the appropriate face conveyor 3 and the appropriate units of shield-type support 12. The direction of the face mining is illustrated by the arrow A. The filling material, consisting of a solids-water-mixture, is forced by means of a solids-handling pump 9 in the face parallel tunnels 4, 5 or via the hydraulic pressure of the shaft structure via drilling hole 6 into the controlled caving area 1. In the illustrated examples, drilling hole 6 from the face parallel tunnels 4, 5 are installed in the face-controlled caving area 1. However, it is possible to supply the required boreholes 6 from other mining installations which are located closer to the controlled caving area 1.

Figure 2:
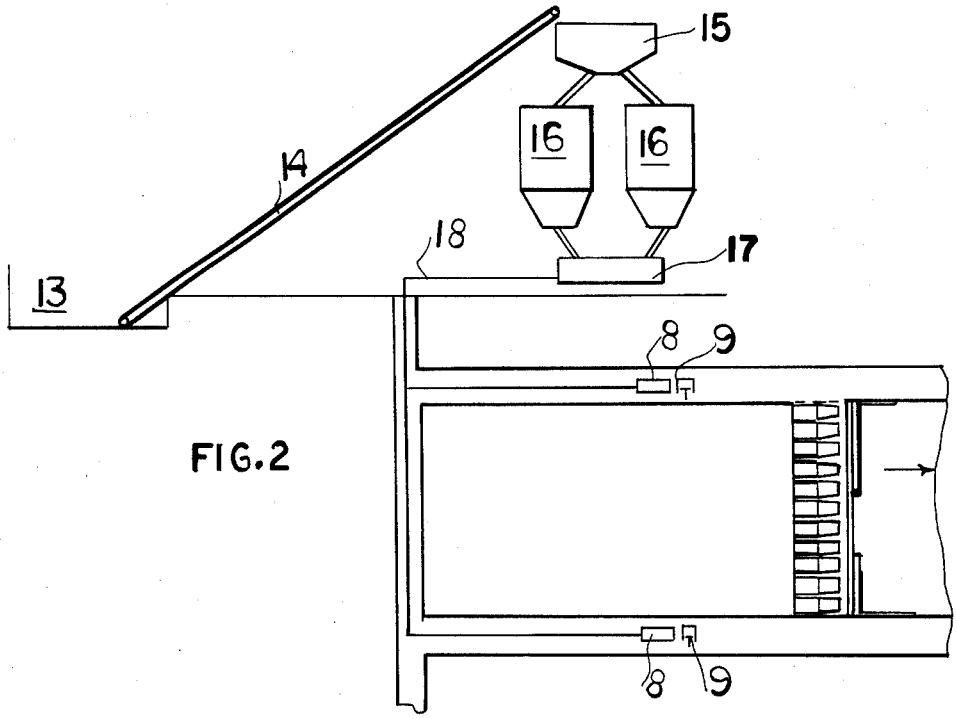
FIG. 2 is an elevation in schematic form of executing the inventive method of backfilling.

In the illustrated example of FIG. 2, the mixture is produced in a container 8 by means of an agitator and pumped by a piston pump mine to a controlled caving area, first through a pipeline 7 to boreholes 6, in addition via pipeline 10 into the face 2 and from there via pipeline 11. The specific example here is suitable for the deployment of limited filling materials. The supply of the filling material for container 8 may be facilitated by mining lorries, EHB containers or tank wagons. Alternatively, the filling materials may be transported pneumatically, for example, via dam building material transportation facilities, in order to facilitate the mixing at the controlled caving area itself.

For the purpose of handling larger quantities of filling material, it is advantageous to construct backfilling facilities both below and above ground. Such a facility for the purpose of executing the procedure is suggested in the schematic description of FIG. 2. The filling material is stored, above ground, in a bin 13 and is transported via a conveyor 14 to a mixing unit 15. Via mixing unit 15, the filling material is carried to two silos 16 and from there via a pump 17 to a pipeline 18 which is used to transport the filling material below ground. Below ground, the use of a shaft pressure pipeline is required, in addition to other transportation pipelines and pipe switches leading to specifically connected areas of use. According to the distance of the shaft and the available pressure, additional pumping stations are required and a pumping station at the area of operation in the form of a backfill top.

The mixture is made up of minute and fine-grained filling materials, for example, electrostatic filter ash and water. The electrostatic filter ash may be processed with water to arrive at a mixture with a high solids content. The solids content of the filling material water mixture amounts to 50 to 70% by volume electrostatic-filter-ash, well settled, and discharges excessive water quickly. The highly concentrated mixture may be processed with solids-handling pumps.

Hollow spaces of controlled caving areas are filled solidly with the mixture made up with a specific solids content. The absorbtive capacity of the debris is capable of absorbing the excessive water. The total filling of the controlled caving area was a mixture of electrostatic filter ash and water leads to an extremely small compressibility which amounts to 6 to 8% of the original thickness of the seam. This figure is particularly significant when it is considered that the compressibility of untreated areas of controlled caving lies somewhere around 40%, and amounts to 30% in the case of pneumatic packing.

After a short time, the electrostatic filter ash-water-mixture is reduced, without additional materials to an adequate solid state to avoid sloping. With the high solids concentration, the pumping of the electrostatic filter ash water mixture may be commenced after lying still for days through pipe and hose lines. As such, it is possible to work with the distribution pipes and the face area. Cleaning of the pipes is necessary only after prolonged interruption. Absence of binding materials or agents makes it possible to clean face installations as well as other lines, hoses and armatures that is fitting. The backfill operation improves working conditions in the face areas because of the dust-free distribution of the backfill materials and the simplification of the mining installations.

Figure 3:
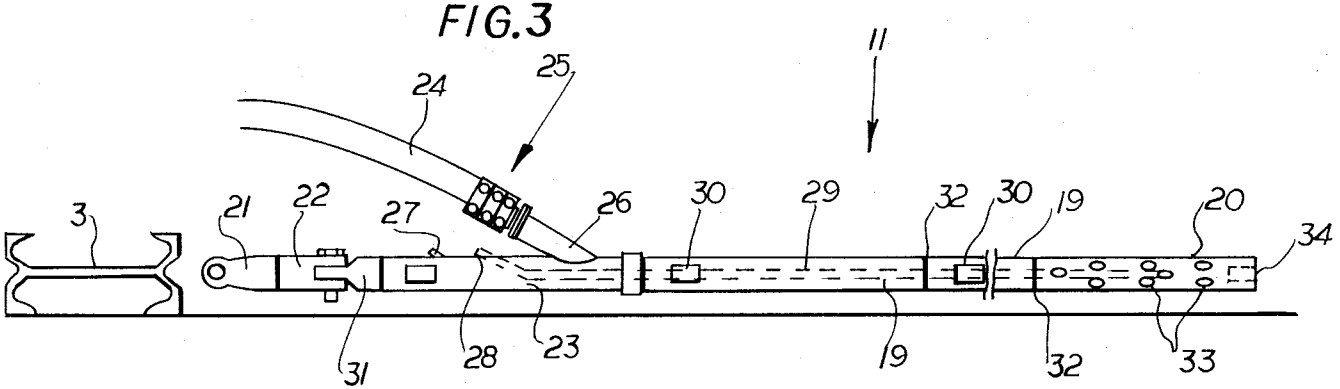
FIG. 3 is a side view of a schematically illustrated example of a pipeline for the purpose of backfilling subterranean hollow spaces.

FIG. 3 shows the side view of pipeline 11 which is attached to conveyor 3 by means of a universal joint in connection with a clutch part 22 and a pipe connection 31. To the pipe connection 31 a connecting pipe 23 is attached which is filled with an intake socket 26 for the purpose of connecting to supply hose and a connecting socket 27 for flushing water and a connecting socket 28 for transporting high pressure water. Connecting hose 24 which leads from the face line not illustrated in FIG. 1 and which is attached by means of appropriate coupling elements to intake sockets 26.

Attached to intermediate pipe 23 is pipeline 11 which consists of connected transport pipes 19. The transport pipes 19 are constructed with appropriate thick walls; they have a length of 2 meters and may be connected with each other smoothly. The transport pipes 19 are screwed together.

In addition, the transport pipes 19 are filled at the end each with notches 30 for the purpose of attaching wrenches or for the purpose of attaching additional pulling/loading device for pulling entrainment ducts 11. Between the intermediate pipe 23 and the immediately attached transport pipe 19, a clutch is provided in the manner of a clamping nut which affords the possibility of arresting entrainment ducts 11 in a specific position.

All connecting elements, including the transport pipes 19 at their connections with each other, have to be tension proof and must be so connected with each other in such a manner to withstand the pressure from within. At the end of the entrainment duct 11, as shown in FIG. 3, a pipe 20 for discharging the filling material is provided whereby a discharge pipe 20, radial discharge points 33 and an axial discharge point are provided. The radial discharge point 33 is attached in such manner as to avoid obstruction when debris is piled up or when the entrainment duct 11 is moved.

The realization of such a protective device is based, for example, on a specific arrangement of the discharge points 33 in accordance with the direction of flow of the material or is based on additional installations which are to be attached at the outside of the refuse discharge pipe. The connecting socket 28 intended for intermediate pipe 23, leads to a high pressure pipe 29, through which the discharge may flow after prolonged disuse.

As mentioned before, the measurements of entrainment duct 11, especially the inside and outside diameter, wall thickness and the size of the discharge points 33, 34 depend on the required mass of flow and the particular form affecting the duct.

Figure 4:
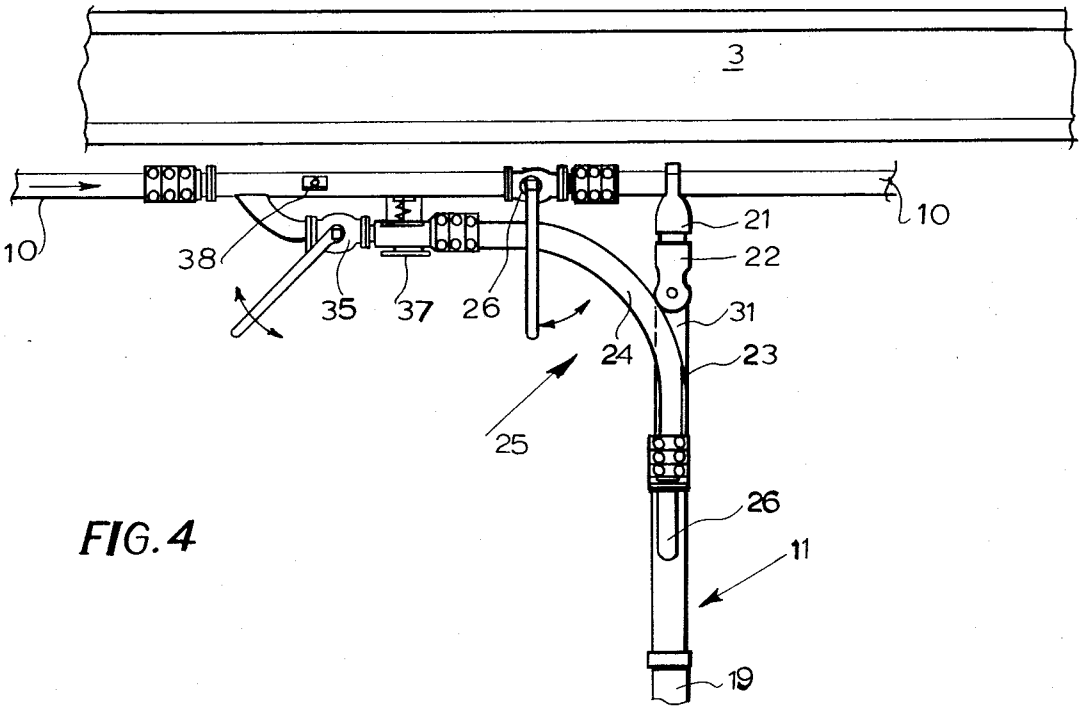
FIG. 4 is a top view of the illustrated example shown in FIG. 1.

As may be seen in the top view of FIG. 4, the entrainment duct 11 is attached to conveyor 11, i.e. to the brackets of conveyor 2 not mentioned in detail. The branch 25, or rather distribution conduit may be attached vertically or horizontally, to save space, in front of entrainment duct 11. Injection of the filling material into entrainment duct 11 occurs within the area of branch point 25 via supply hose 24, branching from the face line, and the shutoff valve in the supply hose 24.

The discharge opening in branch 25 corresponds to the diameter of entrainment duct 11. Via shutoff valve 35 and branch 25 and shutoff valve 36 in the face line 10, the individual entrainment ducts 11 may be supplied by choice, with filling material and may be used to control the backfilling of the controlled caving area.

For purposes of assigning the continuity of the backfilling operation, a pressure valve 37 may be installed to bridge face line 25 and the face line 10 and the shutoff branch 25.

Alternatively, the above-mentioned procedure, the entrainment duct 11, following the backfill operation, may be shut off by means of opening shutoff valve 35 when a predetermined pressure point is reached. The opening of shutoff valve 35 can be facilitated with a motor, which is automatically switched on when a contact indicated in face line 71 registers a specific point of pressure. It is useful to install in each branch 25 a pressure gauge 38, to be constantly aware of the backfilling operation. When the pressure gauge 38 registers increased pressure, it can be assumed that the filling operation is about to be concluded.

We claim:

1. A method of stabilizing a subterranean structure which contains a mine tunnel, comprising the steps of:
   recovering electrostatic filter ash;
   controllably collapsing a rock structure in a region of said tunnel to form a mass of debris containing interstitial hollow spaces;
   forming a thixotropic slurry of said electrostatic filter ash and water;
   injecting said slurry hydrostatically into said interstitial hollow spaces to at least partially fill said spaces within said mass of debris at boundary zones thereof, said slurry being constituted of 50 to 70% by volume fine-grained solids consisting predominantly of said electrostatic filter ash and of water; and
   absorbing water from said slurry into said debris to cause, said solids to form a packing supporting adjoining rock structures against collapse.

2. The method defined in claim 1 wherein said slurry is pumped into said spaces.

3. The method defined in claim 1 wherein said slurry is driven into said spaces by hydrostatic pressure.

4. The method defined in claim 1 wherein said slurry is introduced into said spaces from a mining zone of said tunnel adjacent a region of said tunnel in which collapse has been effected.

5. The method defined in claim 4 wherein said slurry is injected into said spaces by a duct entrained with a traveling portion of a mining machine.

6. The method defined in claim 1 wherein said slurry is injected into said hollow spaces at a number of locations around said debris.

7. The method defined in claim 1 wherein said slurry is injected into said hollow spaces during tunnel face mining over the total length of the tunnel.

8. The method defined in claim 1 wherein said slurry is injected into hollow spaces of said debris adjoining subterranean strata to stabilize other tunnels and drifts therein.

9. The method defined in claim 1 wherein said slurry is introduced into said debris to form a fire barrier.

10. The method defined in claim 9 wherein said slurry is introduced into said debris over boundary regions thereof to isolate a fire.

* * * * *